US007106881B2

(12) United States Patent
Backman

(10) Patent No.: US 7,106,881 B2
(45) Date of Patent: Sep. 12, 2006

(54) SPEAKER

(75) Inventor: Juha Backman, Espoo (FI)

(73) Assignee: Nokia Corporation, Espoo (FI)

( * ) Notice: Subject to any disclaimer, the term of this patent is extended or adjusted under 35 U.S.C. 154(b) by 368 days.

(21) Appl. No.: 10/174,235

(22) Filed: Jun. 17, 2002

(65) Prior Publication Data

US 2003/0059080 A1 Mar. 27, 2003

(30) Foreign Application Priority Data

Jun. 19, 2001 (FI) ..... 20011303

(51) Int. Cl.
*H04R 25/00* (2006.01)

(52) U.S. Cl. ..... 381/408; 381/396; 381/412

(58) Field of Classification Search ..... 381/150, 381/152, 191, 396, 401, 408, 431, 182, 186, 381/410

See application file for complete search history.

(56) References Cited

U.S. PATENT DOCUMENTS

| | | | | | |
|---|---|---|---|---|---|
| 3,247,925 | A * | 4/1966 | Wamaka | 381/398 |
| 3,553,392 | A * | 1/1971 | Liebscher et al. | 381/152 |
| 4,198,550 | A * | 4/1980 | Matsuda et al. | 381/354 |
| 4,252,211 | A | 2/1981 | Matsuda et al. | 181/166 |
| 4,334,127 | A * | 6/1982 | Shimada et al. | 381/431 |
| 4,426,556 | A | 1/1984 | Saiki et al. | 179/115.5 |
| 4,550,428 | A | 10/1985 | Yanagishima et al. | 381/86 |
| 4,653,103 | A | 3/1987 | Mori et al. | 381/99 |
| 4,675,907 | A * | 6/1987 | Itagaki et al. | 381/152 |
| 5,007,707 | A * | 4/1991 | Bertagni | 359/444 |
| 5,638,456 | A * | 6/1997 | Conley et al. | 381/190 |
| 5,693,917 | A * | 12/1997 | Bertagni et al. | 181/173 |
| 5,796,854 | A * | 8/1998 | Markow | 381/385 |
| 6,069,965 | A | 5/2000 | Takewa et al. | 381/404 |
| 6,111,972 | A * | 8/2000 | Rigondeau | 381/431 |
| 6,222,931 | B1 * | 4/2001 | Cesati | 381/427 |
| 6,341,167 | B1 * | 1/2002 | Okuyama et al. | 381/407 |
| 6,522,760 | B1 * | 2/2003 | Azima et al. | 381/152 |
| 2001/0026625 | A1 * | 10/2001 | Azima et al. | 381/152 |
| 2002/0118847 | A1 * | 8/2002 | Kam | 381/111 |
| 2004/0208337 | A1 * | 10/2004 | Anciant | 381/410 |
| 2005/0002537 | A1 * | 1/2005 | Azima et al. | 381/152 |

FOREIGN PATENT DOCUMENTS

| | | |
|---|---|---|
| WO | WO-97/09840 | 3/1997 |

* cited by examiner

*Primary Examiner*—Curtis Kuntz
*Assistant Examiner*—Phylesha Dabney
(74) *Attorney, Agent, or Firm*—Harrington & Smith, LLP

(57) ABSTRACT

A speaker 300 is formed using a plate such as a mobile phone display window 310 as a vibrating element. At least two dynamic actuators 950 are positioned behind the edges of the window 310 to actuate the window 310 through its boundary region so as to leave a large uniform area behind the vibrating element for containing any components, e.g. a display or battery.

20 Claims, 5 Drawing Sheets

SPEAKER

FIELD OF THE INVENTION

This invention relates to speakers. It relates particularly, but not exclusively, to dynamic plate speakers.

BACKGROUND OF THE INVENTION

Electrical speakers are used to convert electrical signals to acoustical signals. The speakers may vary greatly in size and power, but generally they can be divided into two categories: dynamic speakers such as cone speakers commonly used in home HI-FI sets, and electrostatic speakers such as piezoelectric speakers used in buzzers, for example in digital watches and electric alarm clocks. Dynamic speakers typically have an electromagnetic actuator that moves a vibrating element (typically a diaphragm) that passes its vibration to the surrounding air and causes audible acoustic signals.

U.S. Pat. No. 4,653,103 presents one dynamic speaker implementation in which a diaphragm carries a plurality of voice coils attached on both sides of the diaphragm. The diaphragm is sandwiched between two yoke plates, which bear columnar magnets. The yoke plates have holes for allowing the passage of sound. In this implementation, the actuator drives the diaphragm practically across all of its area.

Piezoelectric speakers belong to the category of electrostatic speakers. Piezoelectric speakers are based on a piezoelectrically bending plate or strip that vibrates when subjected to an alternating electrical current. Piezoelectric speakers do not require much space and they are light, but their frequency response is often worse than that of dynamic speakers, and as the maximum movement of their sound-producing element (the plate) is relatively short, compared to dynamic speakers, they are outperformed by dynamic speakers at lower frequencies.

In general, the smaller the speaker, the more limited are its power, frequency response linearity and frequency band of sound production. The acoustic power a speaker produces is a product of the area of the cone (within a plane transverse to the movement of the cone) and the length of the movement.

Speakers are used in mobile devices such as portable radios, mobile telephones, portable computers, Personal Digital Assistant (PDA) devices and electronic games. In many such mobile devices, their size (volume) determines the amount of functionality the devices can have, that is the amount of electronics and battery space that they can contain. Therefore, it is desirable to reduce the amount of space occupied by all components of such devices including the space occupied by speakers.

As mentioned in the foregoing, piezoelectric speakers are small and light, but they have limited audio quality, particularly since their frequency response is moderate at low acoustic frequencies. On the other hand, dynamic speakers typically have a construction based on a magnet sound coil pair in the middle of the speaker to actuate a vibrating diaphragm. The geometry of the speaker is important to avoid undesired effects well known in the art, such as narrow-band resonance and rocking.

FIG. 1 shows an example of a dynamic (descant) speaker 100 in a sectional view. The speaker has a conical frame 110, which co-axially supports an actuator 120 and compliant surround 112, aligning all these around a shared central axis. The surround 112 attaches a cone 130 to the frame 110 at a mouth of the cone 130 (that is, at the broader end of the cone

130). At the throat (the narrower end of the cone 130) the cone 130 is shaped so that it forms a short cylindrically shaped voice coil support or former 134. The former 134 may be a seamless extension of the cone 130 or a part fixed to the cone 130, but in either case it is here referred to as a part of the cone 130. In addition to the surround, a so-called spider 114 (also co-axial with the frame 110, actuator 120 and surround 112) supports the former 134 with respect to the frame 110. The cone 130 is thus supported such that it is allowed to move easily closer to and away from the actuator 120, but restrained from free movement in a transverse direction. The access of dust into the throat is blocked by a dust cap, which is mounted on the cone 130 and thus vibrates together with the cone 130 when the speaker 100 is used.

The actuator 120 comprises two main parts: a magnet 121 and a voice coil 127, which together convert an electrical signal into vibration. The voice coil 127 is fixed to the former 134 and the magnet 121 is fixed to the frame 110. The actuator further comprises a front plate 122, a back plate 123 and a pole piece 126, all of these being circular, for making a stronger and more homogenous magnetic field through the voice coil 127. The voice coil 127 on the former 134 is surrounded by the front plate 122 and the pole piece 126 such that a narrow air gap 125 is left between the front plate 122 and the pole piece for receiving the former 134 and the voice coil 127.

As is apparent from FIG. 1, the actuator 120 occupies the central area behind the cone 130 except for a vent 124 left in the centre of the pole piece 126. This reduces space available for locating any other components behind the voice coil 127. This is particularly inconvenient in relatively thin devices such as portable information processing devices, because the speaker 100 may easily consume most of the depth of such a device.

With plate speakers, as opposed to cone speakers, the vibrating surface may be manufactured to be thinner, but resonance tends to adversely affect the audio response selectively at the resonance frequency bands. WO 97/09840 discloses one alternative dynamic plate speaker, wherein a different approach has been taken to deal with the generally undesired resonance phenomena. There, a single dynamic actuator is placed underneath a stiff cover plate of a speaker box for vibrating the cover plate. The actuator is non-centrally positioned in relation to the area of the cover plate such that it causes the cover plate to resonate over a broad frequency band thus improving the efficiency of the speaker.

NXT™ has published a Distributed-Mode Loudspeaker (DML) integrated into a visual display device. This speaker has been called NXT SoundVu. Its operation is based on bending waves excited in a transparent cover placed in front of a display. Exciters located at the edges of the transparent cover excite it. The exciters are fixed to a frame surrounding and supporting the transparent cover. The speaker can be used in laptop computers, where the screen is large enough to allow bending the cover on different edges with different exciters according to different signals. The implementation of the SoundVu speaker in each particular use requires solving coupled acoustics problems involved. For designing different SoundVu speakers (with different display devices and transparent covers), the NXT™ have developed special software programs. With these programs computer manufacturers should be able to design custom SoundVu speakers.

The bending of the cover is advantageous in the sense that the air gap behind the cover can be shallow, for example 2.75 mm. This shallow a gap is possible because bending waves of the transparent cover do not move the entire transparent cover as a single vibrating element, thus differing from the plate speaker and the cone speaker described in the foregoing. The sound-production with bending waves is thus far less limited by atmospheric pressure than the sound-production with plate and cone speakers. The bending of a transparent cover can be used in a speaker with relatively large transparent covers, such as a cover for display of a laptop computer having a 35-cm (14-inch) diameter. With smaller displays the coupled acoustics problems becomes more difficult reducing the sound-production performance of the speaker.

It is an object of the invention to avoid or at least mitigate the problems of the prior art.

SUMMARY OF THE INVENTION

According to a first aspect of the invention there is provided a speaker comprising:

a body;

a sound-producing element supported by the body so that the sound-producing element is allowed to vibrate in relation to the body, the sound-producing element having a boundary region;

a former having a first end and a second end, the first end being connected to the sound-producing element the second end carrying an end portion extending in a direction substantially normal to an imaginary best-fit plane of the sound-producing element;

at least one voice coil supported by the end portion;

an actuator supported by the body and comprising the at least one voice coil;

characterised by the actuator further comprising at least two separate force creation units; and the actuator being capable of vibrating the sound-producing element through its boundary region.

Preferably, the boundary region is a region between the outer border of the sound-producing element and the centre of the sound-producing element.

A best-fit plane of the sound-producing element is a plane that least deviates from the form of the sound-producing element. If the sound-producing element is a flat element such as a plate, then the best-fit plane is a plane that perfectly fits to the shape of the sound-producing element.

Using at least two separate force creation units for vibrating the sound-producing element through its boundary region allows actuating the sound-producing element at its edge with a possibility to compensate for any asymmetry of the shape or mass distribution of the sound-producing element by using the at least two force creation units.

Preferably, the sound-producing element is stiff enough to convey vibration caused by the actuator to the centre of the sound-producing element. This allows using at least most of the area of the sound-producing element for sound production, when vibration is conveyed from the edge areas to the centre of the sound-producing element.

Preferably, the sound-producing element comprises a uniform vibrating region that extends across the boundary region and a central region of the sound-producing element. This allows using a large area of the sound-producing element as a moving object, increasing the amount of air forced to move thus increasing the acoustic power of the speaker.

Preferably, the sound-producing element has a particular moment of inertia corresponding to each force creation unit and the force creation units are configured to create separate forces that are in proportion of the corresponding moments of inertia. This allows mitigating the rocking of the sound-producing element.

The configuring of the force creation units to create forces proportional to the moments of inertia allows varying the shape and density of the sound-producing element and also the distribution of the force creation units around the boundary region of the sound-producing element.

Preferably, the at least two separate force creation units are spaced apart. Even more preferably, the at least two separate force creation units are distributed in the boundary region with a substantially similar distance to a neighbouring force creation unit or units along the periphery of the sound-producing element.

Preferably, each of the at least two separate force creation units comprises at least one component that is physically separate, the physically separate component being a voice coil or a magnet.

Preferably, the at least two separate force creation units comprise physically separate voice coils. This allows configuring the force proportions of these force creation units by adjusting the power of electrical signals to be supplied in these force creation units.

Preferably, the at least two separate force creation units comprise separate magnets. This allows configuring the force proportions of these force creation units by selecting magnets that induce desired magnetic fields through the at least one voice coil.

Preferably, the at least two separate force creation units are configured to subject the sound-producing element to a vibration according to a signal of an equal form. This allows simple design of the speaker, as the at least two separate force creation units can be driven by the same electrical signal or signals having at least the same form even if they may have a different amplitude and/or phase. The differences in amplitude and/or or phase are simple to make with cheap components.

It is an advantage of a substantially peripherally located actuator that room is left in a space defined by the actuator and the sound-producing element so as to allow receiving any components not required for the speaker itself. In other words, preferably the actuator is farther from the centre than from the outer border of the sound-producing element. This leaves room in the middle of the speaker, behind the sound-producing element when seen from outside of the speaker.

Preferably, the at least one voice coil comprises voice coil portions each aligned at a different pole of a same magnet. This allows using both poles of a magnet for actuating the sound-producing element by the two voice coil portions.

Preferably, the speaker comprises at least two voice coils.

Preferably, the speaker has at least two voice coils and two magnets for forming at least two pairs of a magnet and a voice coil.

Preferably, the actuator further comprises at least one magnetically conductive part for each of the magnets forming at least two pairs of a magnet and a magnetically conductive part for generating magnetic flux between the magnets and the magnetically conductive parts through the at least two voice coils. Typically, the magnetically conductive part is a yoke made of metal.

Preferably, when considered in plan-view, the at least two voice coils are positioned closer to the outer border of the sound-producing element than to the centre of the sound-producing element.

Alternatively, a single voice coil has been looped substantially along the outer border of the sound-producing element, closer to the outer border than the centre of the sound-producing element. In this case, the same voice coil is adapted to generate a vibrating force to the sound-producing element close to the outer border of the sound-producing element allowing actuating the sound-producing element by different sides of the outer border.

Preferably, when considered in plan-view, the former is functionally connected to the actuator nearer to the outer border than the centre of the sound-producing element, at different sides of the outer border.

Preferably, the actuator is functionally connected to the sound-producing element near three or four different sides of the outer border.

Preferably, the sound-producing element is a flat element. Preferably, the sound-producing element has a substantially smooth surface. Preferably, the flat element has an arbitrary shape in the imaginary best-fit plane. Alternatively, the flat element has a regular shape such as oval, ellipse, circle, rectangle or polyedri, in the imaginary best-fit plane.

Preferably, the flat element may be bent or curved to conform to an arbitrary or regular shape such that it has local deviations from the imaginary best-fit plane.

The differentiation of the shape of the sound-producing element allows for customising the sound-producing element to various uses, for example to form a portion of a portable device such that it conforms to the overall shape of the portable device.

Preferably, the sound-producing element is a transparent part adapted for use as a surface of a mobile device. Preferably, the transparent part is adapted for covering an optical user interface device. Preferably, the optical device is a display, a camera, a scanner or a fingerprint reader.

The use of the sound-producing element as a part of a mobile device allows synergetic double action both as a sound-producing member and also as a cover or protector of a component of the mobile device.

According to a second aspect there is provided a host device comprising:

a body;

a sound-producing element supported by the body so that the sound-producing element is allowed to vibrate in relation to the body, the sound-producing element having a boundary region;

a former having a first end and a second end, the first end being connected to the sound-producing element the second end carrying an end portion extending in a direction substantially normal to an imaginary best-fit plane of the sound-producing element;

at least one voice coil supported by the end portion;

an actuator supported by the body and comprising the at least one voice coil;

characterised by the actuator further comprising at least two separate force creation units; and the actuator being capable of vibrating the sound-producing element through its boundary region.

Preferably, the host device is selected from a group consisting of: an electronic game, a PDA device, a mobile communications device, an electronic book, a portable computer or a clock.

BRIEF DESCRIPTION OF THE DRAWINGS

The invention will now be described, by way of example only, with reference to the accompanying drawings, in which.

DETAILED DESCRIPTION

Figure 1:
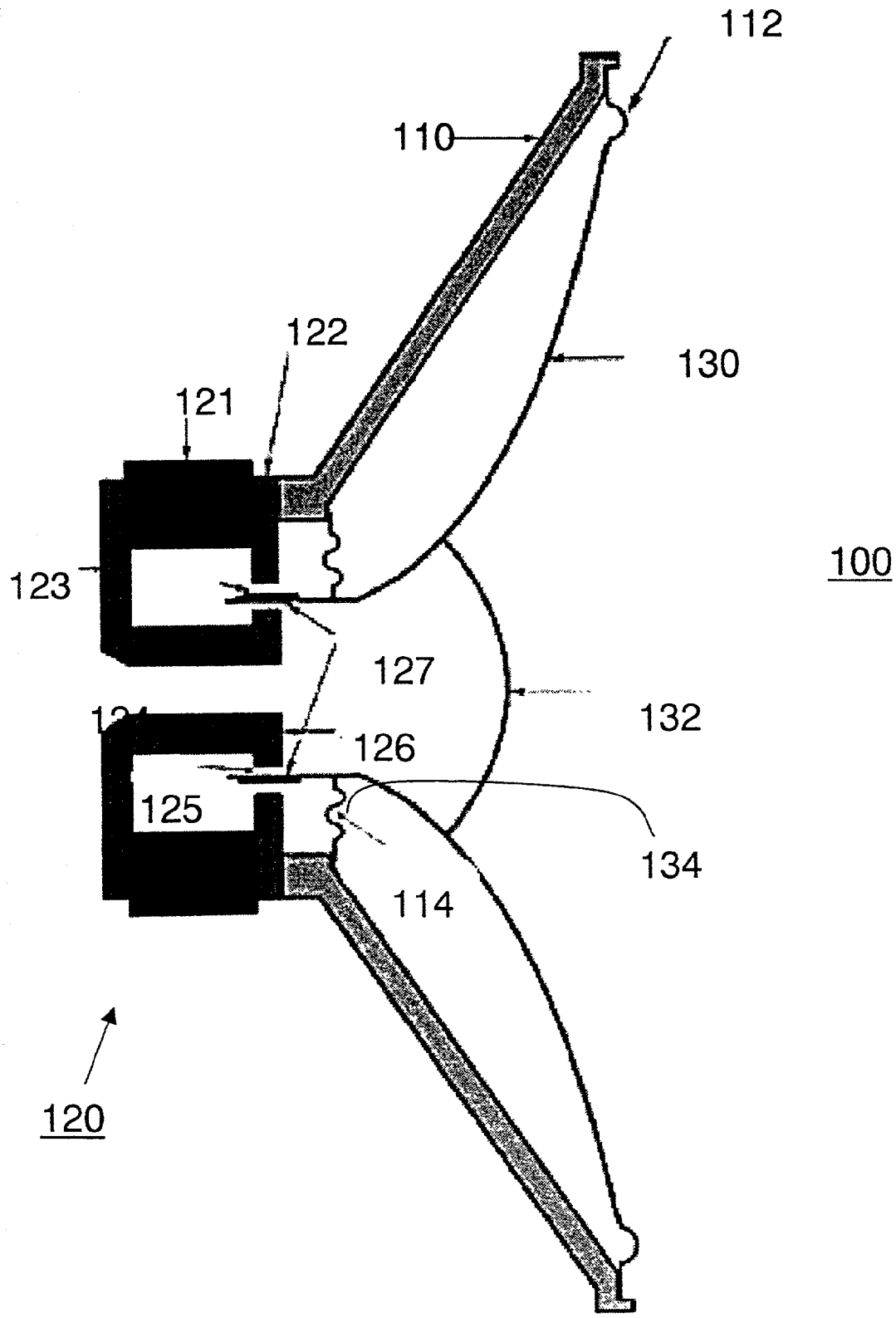
FIG. 1 shows a schematic drawing of a prior art dynamic cone speaker in a sectional view.

FIG. 1 has been described in the foregoing. In the following, corresponding reference signs have been applied to corresponding parts.

Figure 2:
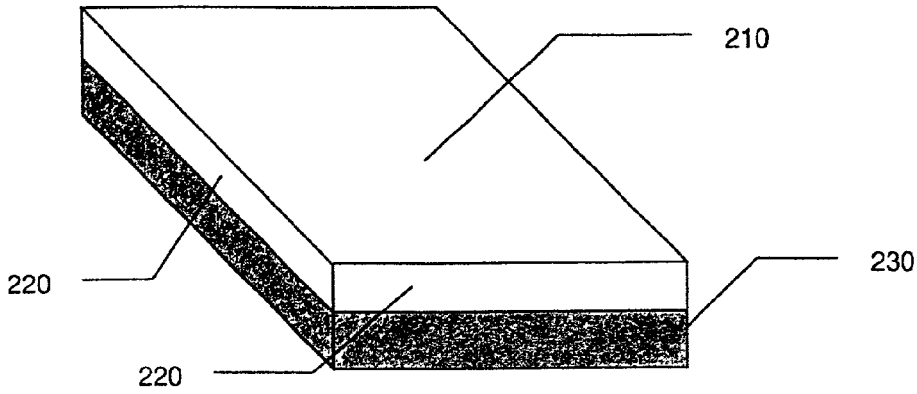
FIG. 2 shows a vibrating element of a speaker according to a first embodiment of the present invention.

FIG. 2 shows a vibrating element 210 of a speaker according to a first embodiment of the present invention. The vibrating element 210 is a window for protecting a display of a host device such as a mobile telephone or like (shown in FIG. 9). The entire vibrating element is also a sound-producing element. The vibrating element is a rectangular plate. At its edges, formers 220 are connected to the vibrating element 210 so that together with the vibrating element they form a box of which the top, vibrating element, is designed to be flush with surrounding surface of the host device. A voice coil 230 is wound around the formers 220 in a shape of a rectangular loop.

Figure 3:
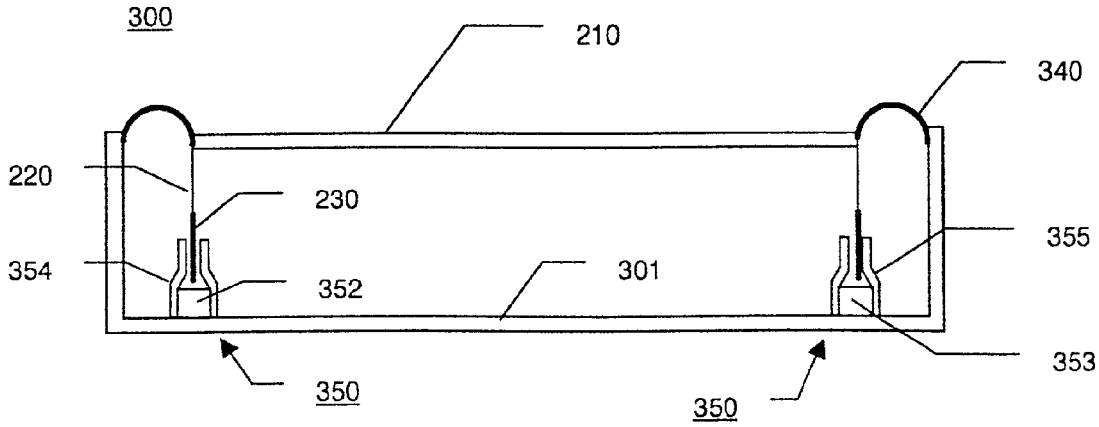
FIG. 3 shows a sectional schematic drawing of a speaker having the vibrating element of FIG. 2.
Figure 4:
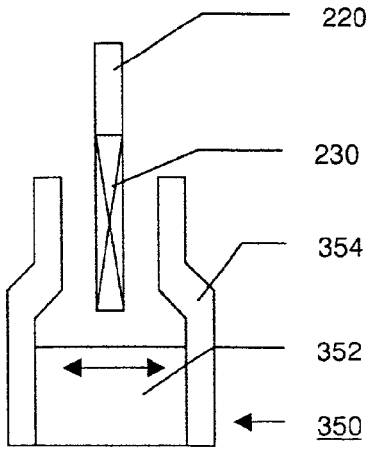
FIG. 4 shows a sectional schematic drawing of an actuator of the speaker of FIG. 3.

FIG. 3 shows a sectional schematic drawing of a speaker 300 having the vibrating element 210 of FIG. 2. A body 301 frames the speaker 300. At the edges of the vibrating element 210, a compliant surround 340 is attached to the vibrating element 210 for supporting the vibrating element 210 by the body 301 of the speaker 300. Also at the edges of the vibrating element 210, the formers 220 extend away from the vibrating element 210. At a free end of the formers 220 (that is, at an end portion), the voice coil 230 is shown between pole plates 354, 355 of an actuator 350. The pole plates 354, 355 are coupled to magnets 352 and 353, which typically are separate row magnets for each side of the vibrating element 210 or for each former 220. The magnets are relatively strong, causing a magnetic field of approximately 0.5 T through the voice coil 230 in order to provide the speaker 300 with a good efficiency. In a plan-view, the pole plates 354, 355 may form one continuous object surrounding the voice coil 230. In alternative embodiments the pole plates 354,355 are separate elements for one or more sides of the vibrating element 210. The magnet 352 and pole plates 354 are also shown in FIG. 4.

The body 301 may be a recess formed in a body of a host device carrying the speaker 300 or a part of the speaker 300.

FIG. 3 basically illustrates that the vibrating element 210 is driven at its edges (that is, at its outer border) by the formers 220 which support the voice coils between the pole plates 354, 355. The vibrating element 210 can be made of stiff injection-moulded transparent plastic and it will vibrate over its entire area providing a relatively large area for use in sound production. The stiffness may be improved by particular profiling of the vibrating element 210. Other profiling may also be applied, for example for improving the aesthetic appearance of the vibrating element 210 or for making it magnifying.

The weight of the vibrating element 210 affects the sound production: the lighter the vibrating element 210 is, the higher frequencies the speaker 300 can produce. Using a display window as a speaker part makes effective use of the surface area of a host device thus providing possibility of producing relatively good quality sound without needing to provide any sound conveying conduits from the interior of the device to its surface. That the vibrating element 210 is driven from its edge areas further allows using of different shapes of vibrating elements 210. In this illustrative example, the vibrating element is driven at its very edges, but in an alternative embodiment the vibrating element may be driven close to the edge. In this case, a rim extends from the joint of the former 220 and the vibrating element 210. In either case, the joint is typically closer to the border of the vibrating element than its centre, when considered in plan-view.

The behaviour of the vibrating element 210 can be controlled, for example, by adapting the position or length of magnets and/or pole plates to the shape and size of the vibrating element 210. These parameters can be optimised empirically or, preferably, by computerised optimisation.

The operation of a speaker can also be optimised electrically in an embodiment of the invention wherein separate voice coils 730 are used. This form of optimisation will be explained with reference to FIG. 7.

The construction of FIG. 3 and FIG. 4 requires some depth in the direction in which the formers 220 extend in order to provide space for the magnets 352, 353, but this is not typically a severe problem since the depth of the speaker 300 can be utilised in occupying components of the host device.

FIGS. 4, 5, 6 and 8 show four different embodiments of actuators. In these figures, a two-headed arrow indicates the poles of a magnet. In case of FIGS. 5, 6, 7 and 8, the actuator is asymmetric and it can be freely chosen in which of the two possible positions the actuator is constructed. For example, a magnet 352 or 652 can be on an outer or inner side of the voice coil when seen from the centre of a speaker.

Figure 5:
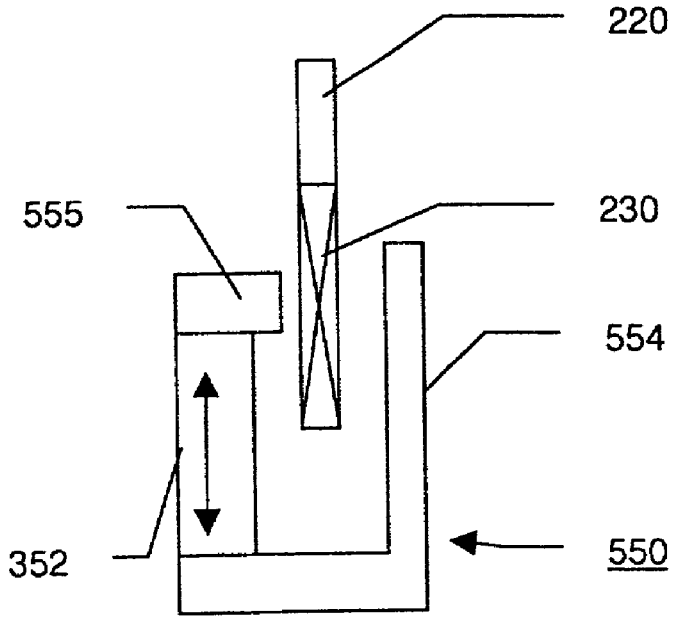
FIG. 5 shows a section of a first alternative actuator for a speaker of FIG. 3.

FIG. 5 shows a section of a first alternative actuator 550 for a speaker 300 of FIG. 3. As opposed to the basically U-shaped structure in which the magnet is located on the bottom of the U-letter and the sides are formed of pole plates, in this actuator 550 a first pole plate 554 forms a first side and the bottom of a roughly U-shaped structure. A magnet 352 forms another side of a U-shape, and on top of the magnet 352, a second pole plate 555 completes a magnetic circle through the voice coil 230. This structure is particularly useful in applications in which a small depth of the speaker 300 is desirable.

Figure 6:
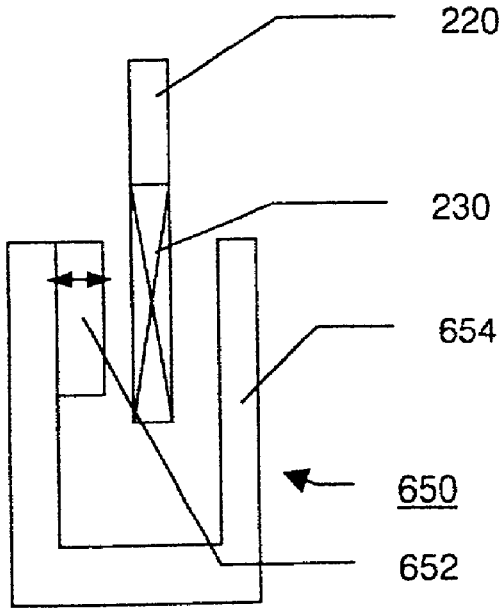
FIG. 6 shows a section of a second alternative actuator for a speaker of FIG. 3.

FIG. 6 shows a section of a second alternative actuator 650 for a speaker 300 of FIG. 3. A single U-shaped pole plate 654 carries on the inner surface of one wall of a magnet 652. This structure results in a relatively small weight compared to the other embodiments.

Figure 7:
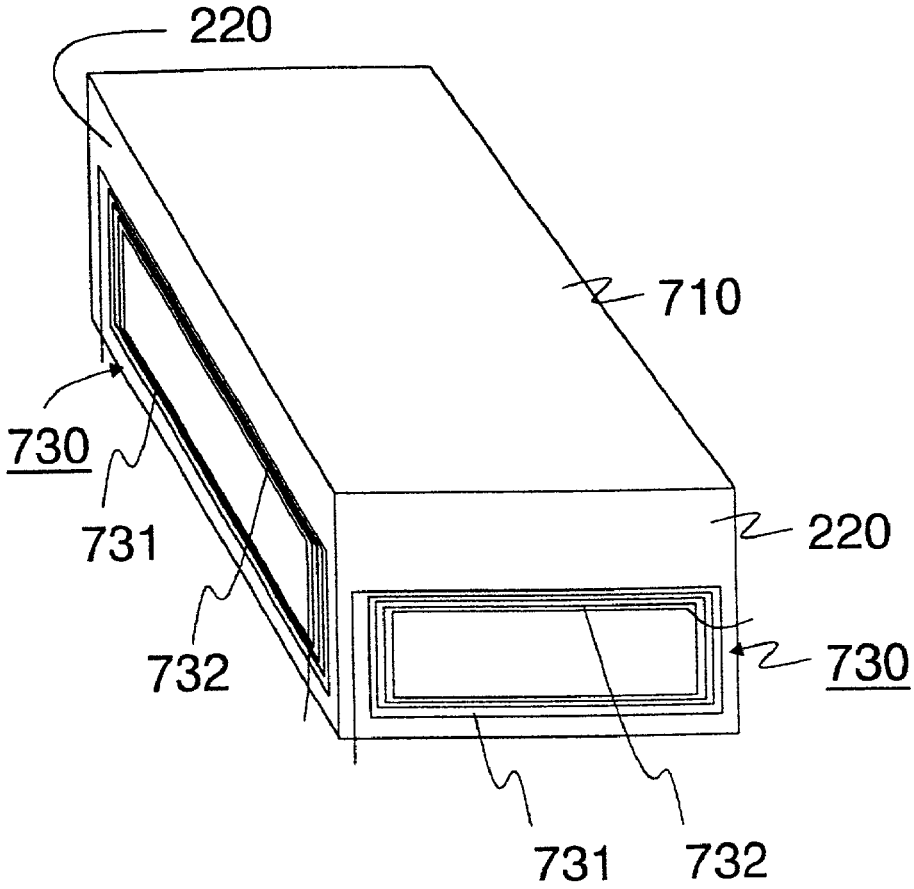
FIG. 7 shows a schematic drawing of a vibrating element of a speaker according to a second embodiment of the present invention.

FIG. 7 shows a schematic drawing of a vibrating element 710 of a speaker according to a second embodiment of the present invention. FIG. 7 also shows two distinct voice coils 730 applied on two different formers 220. Each voice coil 730 is located on the surface of (or alternatively inside) a former such that it forms a first group of conductors 731 in one direction and a second group of conductors 732 in the opposite direction. The purpose of this becomes clear when looking at FIG. 8 which shows a sectional drawing of an actuator for the speaker of FIG. 7.

A speaker having the vibrating element of FIG. 7 can be electrically optimised such that the electrical power supplied to different voice coils 730 is balanced according to a particular proportion in order to minimise the rocking of the vibrating element 710. When designing a speaker, the electrical power that is supplied to each particular voice coil 730 can be determined by computer optimisation or empirically. Furthermore, the respective amounts of electrical power provided to different voice coils 730 may be altered during the operation of the speaker such that it can be dynamically controlled, for example, according to a predetermined function of the loudness of sound being produced and its frequency spectrum. There are thus two basic ways presented for optimising a speaker so that rocking is minimised: either with static, design-dependent construction of the speaker, or with electrical adaptation, wherein possible imbalance of the speaker's vibrating element actuation can be compensated electrically. In both cases, the force created by the different force creating units is in proportion with respective moment of inertia of the vibrating element. If the vibrating element has a high moment of inertia with respect of a first force creating unit and a small moment of inertia with respect of a second force creating unit, the first force creating unit should apply correspondingly higher forces to the vibrating element than the second force creating unit.

The force creation units may be operated with equal electrical sound signals, but alternatively these signals differ by amplitude and/or by phase. Even in this case, the form of the signals is the same, because the entire vibrating element is used as a sound-producing element. Varying only the amplitude of the electrical sound signal is simple, because a single amplifier can be used and the adaptation be arranged simply with electrical resistors.

Taking into account the effect of the compliant support of the speaker may further enhance the optimisation. Basically, the forces created by the force creation units should be distributed such that the vibrating element is moved by substantially equally long movements at each force creating unit.

Both in the case of a speaker having an actuator shown in FIG. 3 (a single voice coil and four magnets) and in the case of a speaker having an actuator shown in FIG. 7 (four voice coils and four magnets), the vibrating element is actuated by at least two separate force creation units. In the former case, the force creation units are separate because they have different magnets, and in the latter case the force creation units are separate because they have different magnets and different voice coils. In another embodiment at least two different force creation units are providing by a single ring-magnet (round, rectangular, polygon or other shape) and at least two different voice coils located within the magnetic field of the magnet at different positions around the single ring-magnet.

Figure 8:
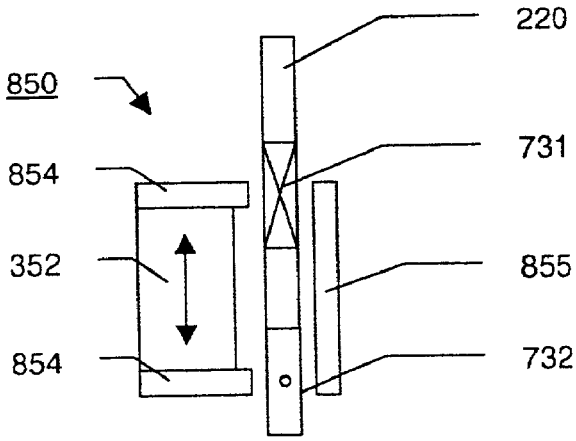
FIG. 8 shows a sectional drawing of an actuator for the speaker of FIG. 7.

FIG. 8 shows a section of one actuator 850 containing the voice coil 730 of FIG. 7. The first and second groups of conductors 731 and 732 can be seen. A magnet 352 is sandwiched between two first pole plates 854. The first pole plates 854 are connected to the opposite poles of the magnet 352 and thus they generate magnetic flux via each pole through the first and second groups of conductors 731 and 732. Since the current flows in opposite directions in the first and second groups of conductors 731, 732, any change in current within the groups of conductors (that is within the voice coil 730) causes two equivalent forces in a common direction. A second pole plate 855 is placed on a side of the former 220 opposite to the magnet 352 and first pole plates 854 so as to provide a magnetically permeable path through which the magnet flux can readily pass. It is an advantage of this construction that the voice coil 730 has a good electromagnetic compliance with any electronic components in the vicinity of the speaker because a large proportion of the voice coil 730 is enclosed by the pole plates 854 and the magnet 352. Such an enclosure provides electrostatic protection and removes or greatly reduces the sensitivity of the voice coil 730 for interference caused by pulsating electrical and/or magnetic fields.

Figure 9:
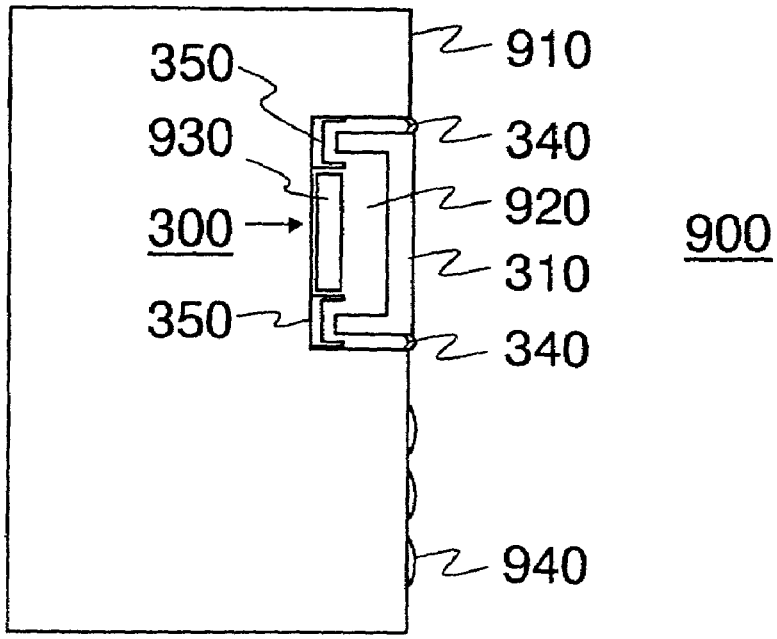
FIG. 9 shows a section of a mobile telephone comprising a vibrating display window as a vibrating element of a speaker according to the first embodiment of the present invention.

FIG. 9 shows a section of a mobile telephone 900 (host device) comprising a display window which is a vibrating element of the speaker 300 according to the first embodiment of the present invention. The mobile telephone comprises a body 910 formed such that it defines a recess 920. A window 310 is attached by compliant support 340 to cover the recess 920. The window 310 covers most of the area of the recess 920 and on its edges it turns towards the bottom of the recess 920 so that in section a pair of formers resembles a wide inverted U-letter. The formers are partly received by actuators 350 located on the bottom of the recess. A component of the mobile telephone, in this case the display 930, has been mounted on the bottom of the recess 920, between the actuators 350, and it occupies most of the bottom of the recess. As can be seen from FIG. 9, nearly all the area behind the vibrating element 310 can be used for containing a component (the display 930) not necessarily part of the speaker 300. FIG. 9 further illustrates the possibility of making a second use out of the vibrating element as a display window 310.

The host device may be any mobile or portable device, such as an electronic game, a PDA device, a mobile communications device such as a mobile telephone, an electronic book, a portable computer or a clock.

The compliant surround 340 also reduces entry of dust into the interior of the mobile telephone 900 thus removing a need for separate dust stops. In order to allow air pass through, it may yet be porous.

The structure shown in FIG. 9 leaves a large, uniform area and space inside the speaker. This allows the interior of a speaker to accommodate a component operationally independent of the speaker, such as the display 930. This advantage can be achieved by forming an actuator of spaced apart magnets that are closer to the edges of the window 910 than to the centre of the window 910, when considered in plan-view. Typically, the centre of mass of a magnet is closer to the edge than to the centre of the window 910.

Of course, although the figures have shown the force being applied at the edge of the vibrating element, in alternative embodiments the force is applied inwardly from the edge. It is common for these different embodiments of using the invention that the vibrating element is actuated through its boundary region. This leaves an space behind the central region of the vibrating element unused by the speaker and available for accommodating, for example, a display.

Particular implementations and embodiments of the invention have been described. It is clear to a person skilled in the art that the invention is not restricted to details of the embodiments presented above, but that it can be implemented in other embodiments using equivalent means without deviating from the characteristics of the invention. The scope of the invention is only restricted by the attached patent claims.

The invention claimed is:

1. A speaker comprising:

a body;

a sound-producing element supported by the body so that the sound-producing element is allowed to vibrate in relation to the body, the sound-producing element having a boundary region;

a former having a first end and a second end, the first end being connected to the sound-producing element for directionally driving the sound-producing element, the second end carrying an end portion extending in a direction substantially normal to an imaginary best-fit plane of the sound-producing element;

at least one voice coil supported by the end portion;

an actuator supported by the body and comprising the at least one voice coil; wherein the actuator further comprises at least two separate force creation units configured to create simultaneous separate forces for vibrating the sound-producing element; and the actuator being capable of vibrating the sound-producing element through its boundary region.

2. A speaker according to claim 1, wherein the sound-producing element is stiff enough to convey vibration caused by the actuator to the centre of the sound-producing element.

3. A speaker according to claim 1, wherein the sound-producing element has a particular moment of inertia corresponding to each force creation unit and the created simultaneous separate forces are in proportion of the corresponding moments of inertia.

4. A speaker according to claim 1, wherein each of the at least two separate force creation units comprises at least one component that is physically separate from at least one other force creation unit, the physically separate component being a voice coil or a magnet.

5. A speaker according to claim 1, wherein the at least two separate force creation units are configured to subject the sound-producing element to at least two vibration signals having an equal waveform.

6. A speaker according to claim 1, wherein the actuator further comprises at least one magnet and that the at least one voice coil comprises two voice coil portions associated with respective poles of a same magnet.

7. A speaker according to claim 6, wherein the actuator further comprises at least one magnetically conductive pole plate for the at least one magnet forming at least one pair of a magnet and a magnetically conductive pole plate for generating magnetic flux between the magnet and the magnetically conductive pole plate through the at least two voice coil portions.

8. A speaker according to claim 1, wherein the speaker comprises at least two voice coils.

9. A speaker according to claim 1, wherein the speaker comprises a single voice coil looped around the former in order to define a path having a shape corresponding substantially to the shape of the sound-producing element.

10. A speaker according to claim 1, wherein the actuator further comprises at least three force creation units spaced around the former.

11. A speaker according to claim 1, wherein the sound-producing element is a flat element.

12. A speaker according to claim 11, wherein the flat element has a non-circular shape.

13. A speaker according to claim 1, wherein the sound-producing element is a part adapted for use as a surface of a mobile device.

14. A speaker according to claim 1, wherein the sound-producing element is a transparent part adapted for covering an optical user interface device.

15. A host device comprising a speaker comprising:

a body;

a sound-producing element supported by the body so that the sound-producing element is allowed to vibrate in relation to the body, the sound-producing element having a boundary region;

a former having a first end and a second end, the first end being connected to the sound-producing element for directionally driving the sound-producing element, the second end carrying an end portion extending in a direction substantially normal to an imaginary best-fit plane of the sound-producing element;

at least one voice coil supported by the end portion;

an actuator supported by the body and comprising the at least one voice coil; wherein the actuator further comprising at least two separate force creation units configured to create simultaneous separate forces for vibrating the sound-producing element; and the actuator being capable of vibrating the sound-producing element through its boundary region.

16. A host device according to claim 15, wherein the host device is selected from a group consisting of: an electronic game, a PDA device, a mobile communications device, an electronic book, a portable computer or a clock.

17. A speaker comprising:

a vibrating element comprising a top surface;

a former comprising a first end portion coupled to the vibrating element and an opposed free end portion extending away from the top surface;

a voice coil supported by the free end portion;

a first pole plate;

and a first magnet disposed adjacent to one another and adjacent to and spaced from the voice coil; and a second pole plate and a second magnet disposed adjacent to one another and adjacent to and spaced from the voice coil;

wherein the first and second magnets are spaced from one another and configured to impart, via the voice coil and former, simultaneous separate forces to the vibrating element.

18. The speaker of claim 17, further comprising a body comprising a recess in which the former, the voice coil, the first and second pole plates, and the first and second magnets are disposed;

a compliant surround disposed between the body and the vibrating element, said compliant surround supporting said vibrating element such that the vibrating element and compliant surround encloses the recess.

19. The speaker of claim 17, wherein the first and second magnets are disposed adjacent to opposed sides of the voice coil.

20. The speaker of claim 17, wherein each of the first and second pole plates comprises a pair of pole plates spaced from one another such that the voice coil lies between said pair of pole plates, and wherein each of the first and second magnets is disposed adjacent to and spaced from the free end portion of the former.

* * * * *